US006101787A

United States Patent [19]

Brintazzoli et al.

[11] Patent Number: 6,101,787

[45] Date of Patent: Aug. 15, 2000

[54] UNIT FOR SUPPLYING BLANKS ON A PACKING MACHINE

[75] Inventors: Roberta Brintazzoli, Monteveglio; Roberto Osti, Zola Predosa; Alessandro Minarelli, Bazzano, all of Italy

[73] Assignee: G.D Societa' per Azioni, Bologna, Italy

[21] Appl. No.: 09/347,187

[22] Filed: Jul. 2, 1999

[30] Foreign Application Priority Data

Jul. 6, 1998 [IT] Italy ..... BO98A0413

[51] Int. Cl.[7] ..... B65B 41/00

[52] U.S. Cl. ..... 53/389.1; 53/234; 493/315; 414/797.7; 271/11

[58] Field of Search ..... 53/389.1, 234; 493/315; 414/797.7; 271/115, 107, 11

[56] References Cited

U.S. PATENT DOCUMENTS

| | | | |
|---|---|---|---|
| 3,201,916 | 8/1965 | McGill | 53/382.2 |
| 3,386,558 | 6/1968 | Benatar . | |
| 3,852,942 | 12/1974 | Johnson et al. | 53/382.2 |
| 3,863,427 | 2/1975 | Rossi | 53/382.2 |
| 3,948,018 | 4/1976 | Rowekamp | 53/251 |
| 4,522,014 | 6/1985 | Robinson | 53/382.2 |
| 4,671,042 | 6/1987 | Moekle et al. | 53/251 |
| 4,735,600 | 4/1988 | Drewke et al. | 493/315 |
| 4,854,930 | 8/1989 | Miselli et al. | 493/315 |
| 5,029,834 | 7/1991 | Boldrini et al. | 271/11 |
| 5,054,761 | 10/1991 | Dietrich et al. | 493/315 |
| 5,061,231 | 10/1991 | Dietrich et al. | 493/315 |
| 5,104,369 | 4/1992 | Calvert | 493/315 |
| 5,454,210 | 10/1995 | Piazza | 53/251 |

FOREIGN PATENT DOCUMENTS

| | | |
|---|---|---|
| 0 425 226 | 5/1991 | European Pat. Off. . |
| 2 478 576 | 9/1981 | France . |
| 2 053 133 | 2/1981 | United Kingdom . |
| 2 207 656 | 2/1989 | United Kingdom . |

*Primary Examiner*—Peter Vo
*Assistant Examiner*—Christopher R Harmon
*Attorney, Agent, or Firm*—Marshall, O'Toole, Gerstein, Murray & Borun

[57] ABSTRACT

A unit for supplying blanks on a packing machine, wherein a wheel, rotating about a respective axis, continuously feeds a blank pickup head along an endless path through a loading station where the pickup head, oscillating with respect to the wheel about an axis parallel to the axis of the wheel, engages a bottom opening of a blank store to withdraw a blank, and then through an unloading station where the pickup head, rotating together with the wheel, feeds the blank onto a conveyor roller.

7 Claims, 3 Drawing Sheets

1
2
3
4
5
6
7
8
9
10
11
12
13
14
15
16
17
18
19
20
21
22
23
24
25
26
27
29
30
37
38
39
52
53
63
64
65
66
S1
S2
P

UNIT FOR SUPPLYING BLANKS ON A PACKING MACHINE

The present invention relates to a unit for supplying blanks on a packing machine.

BACKGROUND OF THE INVENTION

In the following description, reference is made purely by way of example to packing machines for producing rigid packets of cigarettes.

Units for supplying blanks on cigarette packing machines, such as the one described for example in U.S. Pat. No. 5,029,834, comprise a suction pickup head moved cyclically by a crank mechanism substantially back and forth between a pickup position, in which the head engages a bottom opening in a blank store to withdraw a blank, and an unloading position, in which the head feeds the blank onto a conveyor roller.

Though perfectly satisfactory, supply units of the type described above fail to meet the high operating speeds (over 600 packets a minute) demanded by modern cigarette packing machines, owing to the inertia and vibration produced by the substantially reciprocating movement of the pickup head.

FR-A-2,478,576 discloses a packing machine having a unit for supplying blanks and comprising a store for storing blanks, the store having a bottom opening, a pickup head for withdrawing a respective blank and located on a plate connected to a wheel rotating continuously about a first axis to feed the pickup head along an endless path extending through a loading station where the pickup head engages the bottom opening to withdraw a blank. The plate is connected to the wheel to oscillate, with respect to the wheel, about a second axis parallel to the first axis by means of an actuating device.

The supplying unit disclosed in the aforementioned FR-A-2,478,576 is capable to operate at a speed higher than that of the supplying unit disclosed in U.S. Pat. No. 5,029,834, but is not capable to operate with satisfactory results at the high operating speeds (over 600 packets a minute) demanded by modern cigarette packing machines owing to the fact that, at such speed, the pickup head, by moving in a substantially radial direction in relation to the wheel, is not given a sufficient time to properly engage the blank to be withdrawn.

SUMMARY OF THE INVENTION

It is an object of the present invention to provide a unit for supplying blanks on a packing machine, which is straightforward and cheap to produce, provides for eliminating the aforementioned drawback, and therefore enables high operating speed.

According to the present invention, there is provided a unit for supplying blanks on a packing machine, the unit comprising a store for storing blanks and having a bottom opening; a plate having a first end and a second end opposite each other; a pickup head for withdrawing a respective blank and located on said plate, close to said first end; and a wheel rotating continuously about a first axis to feed said pickup head along an endless path extending through a loading station where the pickup head engages said bottom opening to withdraw a said blank; said plate being connected to said wheel to oscillate, with respect to the wheel, about a second axis extending through said second end and parallel to said first axis; and a first actuating device being provided to vary the angular position of said plate about said second axis; the unit being characterized by further comprising a second actuating device for oscillating said plate, with respect to said wheel, about a fourth axis parallel and relatively close to said first axis and along said path.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figures 1, 5:
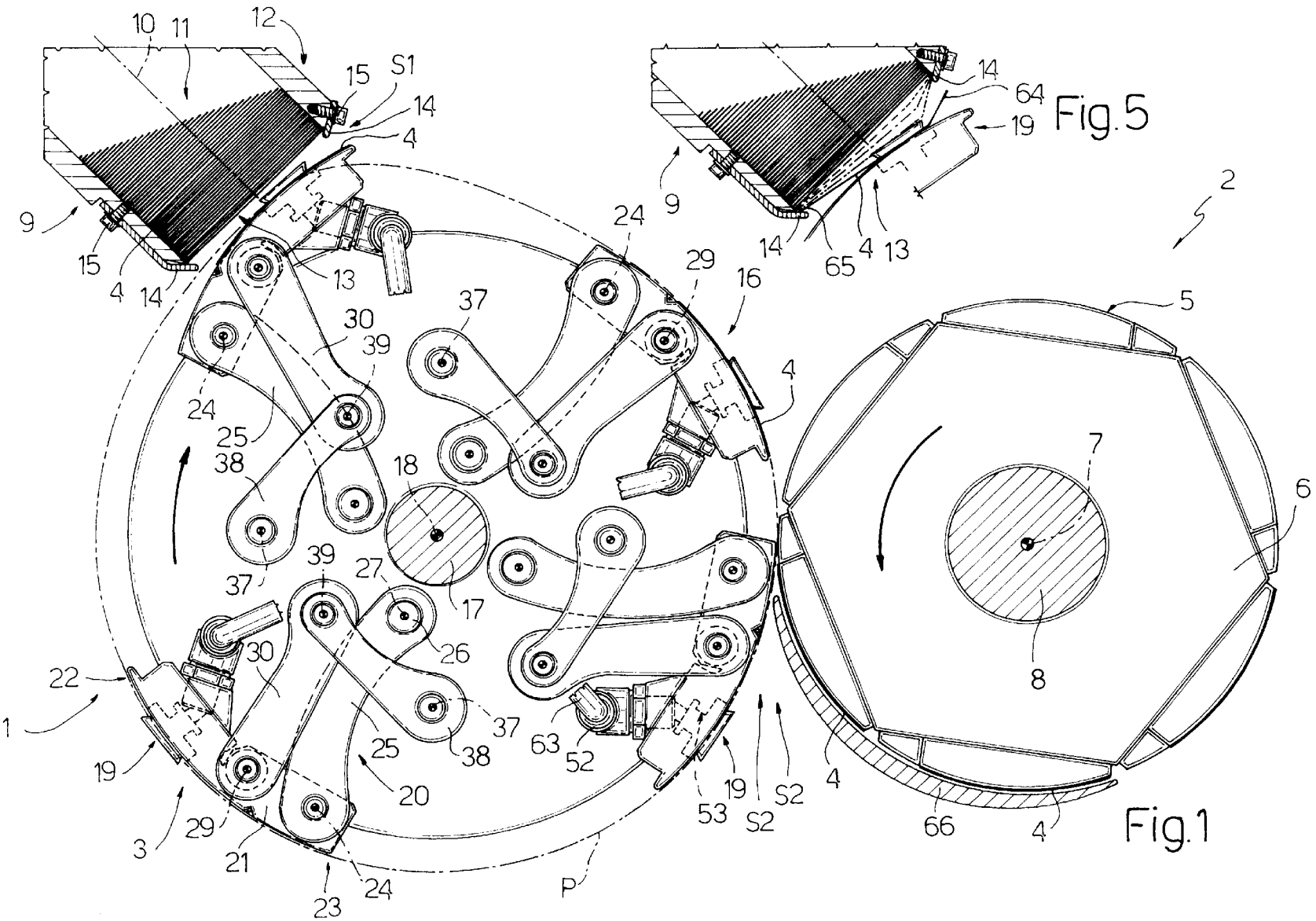
FIG. 1 shows a schematic, partially sectioned front view, with parts removed for clarity, of a preferred embodiment of the unit according to the present invention.
FIG. 5 shows a further detail of FIG. 1 in a different operating position.

Number 1 in FIG. 1 indicates as a whole a supply section of a packing machine 2, comprising a unit 3 for supplying blanks 4 to respective suction seats 5 defined on the outer periphery of a conveyor roller 6, which is rotated continuously counterclockwise in FIG. 1) about a fixed central axis 7 perpendicular to the FIG. 1 plane by a powered shaft 8.

Unit 3 comprises a store 9 having a central axis 10 in the FIG. 1 plane, and housing a stack 11 of substantially rectangular blanks 4. Store 9 extends in a substantially vertical plane, and comprises a bottom portion 12 having a substantially rectangular bottom opening 13 with two teeth 14 fitted to store 9 by respective bolts 15 to retain stack 11 of blanks 4 inside store 9 in opposition to the force of gravity.

Unit 3 also comprises a wheel 16, which is rotated at constant speed (clockwise in FIG. 1) by a powered shaft 17 having a fixed axis 18 parallel to axis 7 and crosswise to axis 10, and supports a number of suction pickup heads 19 equally spaced about axis 18. The continuous rotation of wheel 16 about axis 18 feeds each pickup head 19 along an endless path P through a loading station S1, where pickup head 19 engages bottom opening 13 to withdraw a blank 4 at opening 13, and through an unloading station S2 where pickup head 19 feeds the withdrawn blank 4 to a seat 5 on conveyor roller 6.

Each pickup head 19 is connected mechanically to wheel 16 by the interposition of a respective actuating device 20, which, as pickup head 19 travels through loading station S1, moves pickup head 19 tangentially with respect to the periphery of wheel 16 to keep pickup head 19 facing bottom opening 13 for a time sufficient complete withdrawal of a respective blank 4 at opening 13. Within the same time interval, actuating device 20 moves pickup head 19 radially with respect to wheel 16 to enable pickup head 19 to withdraw blank 4 from bottom opening 13.

As pickup head 19 travels through unloading station S2, actuating device 20 sets pickup head 19 to a fixed position substantially tangential with respect to the periphery of wheel 16 to feed the withdrawn blank 4 to a respective seat 5.

Figure 3:
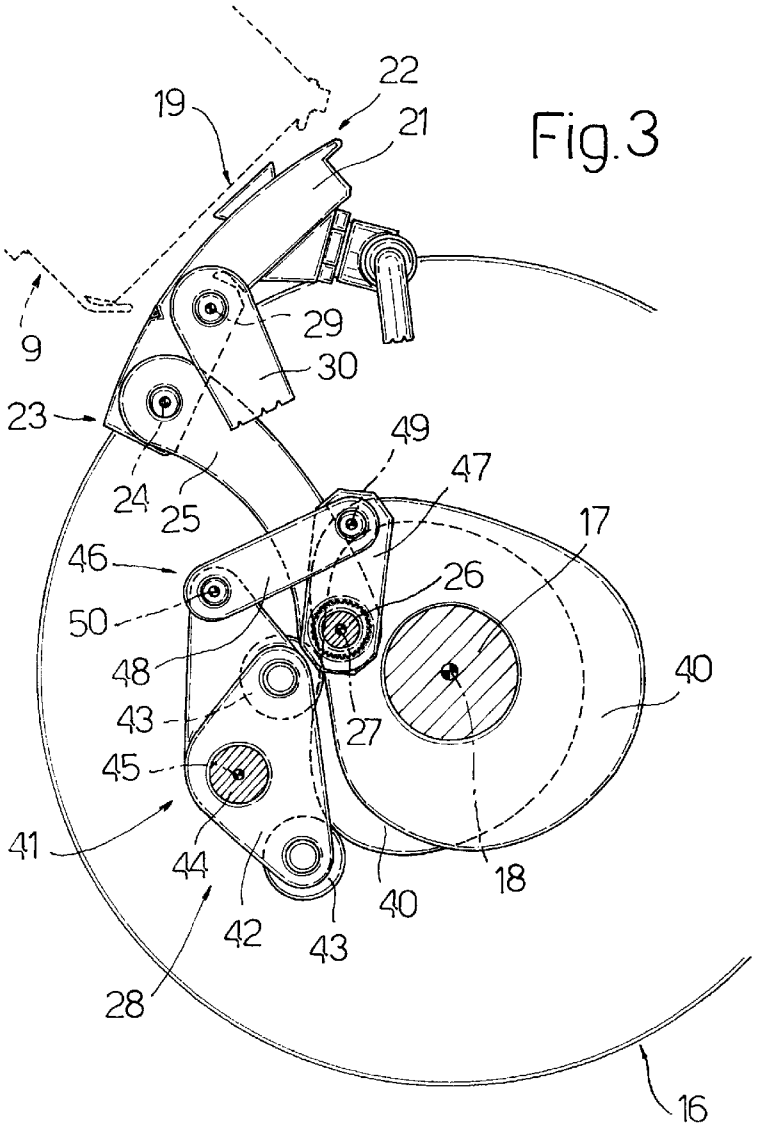
FIGS. 2, 3 and 4 show respective details of FIG. 1.

Each actuating device 20 comprises a plate 21 having an end 22 located at the front in the traveling direction of pickup head 19 and at which respective pickup head 19 is fitted, and an end 23 opposite end 22 and at which plate 21 is hinged at 24 to one end of an arm 25, the opposite end of which is hinged to wheel 16 by a pin 26 and is oscillated, with respect to wheel 16, about an axis 27 by a cam control device 28 (shown in FIG. 3).

At an intermediate portion between ends 22 and 23, each plate 21 is hinged at 29 to one end of an arm 30, which is connected mechanically at the opposite end to a cam control device 31 (shown in FIG. 2) and is moved by device 31 substantially radially with respect to wheel 16.

Figure 2:
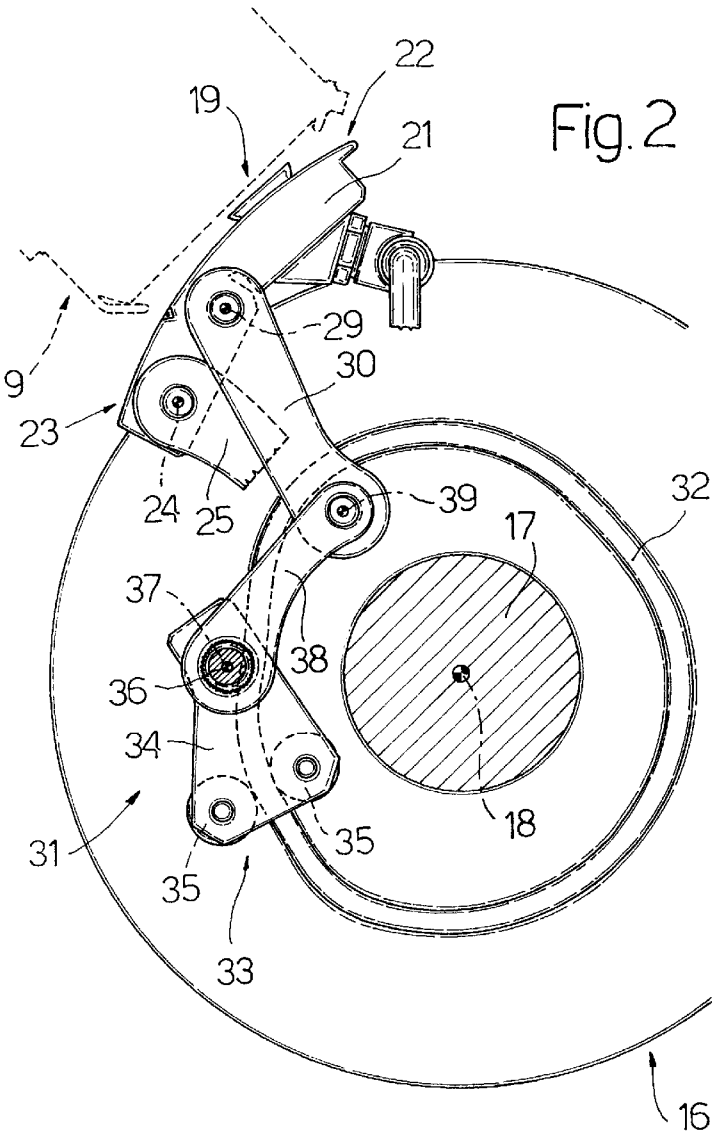

As shown in FIG. 2, each control device 31 comprises a fixed cam 32 extending about axis 18 and cooperating with a follower device 33, which comprises a carriage 34 having two parallel tappet rollers 35 engaging opposite sides of cam 32. Carriage 34 is hinged to wheel 16 by a pin 36 so as to oscillate, with respect to wheel 16, about an axis 37 parallel to axis 18, and defines a first arm of a rocker arm pivoting on wheel 16 at axis 37 and comprising a second arm 38, the end of which, opposite the end integral with carriage 34, is hinged at 39 to a free end of a respective arm 30.

As wheel 16 rotates about axis 18, the profile of cam 32 causes each carriage 34 and respective arm 38 to oscillate about axis 37 and so move arm 30 substantially radially with respect to wheel 16, which radial movement of arm 30 in turn causes plate 21 to oscillate with respect to arm 25 about axis 24 and so move pickup head 19 substantially radially with respect to wheel 16, As shown in FIG. 3, each control device 28 comprises two fixed cams 40 extending about axis 18, offset axially with respect to each other, and cooperating with a follower device 41, which comprises a carriage 42 having two tappet rollers 43, each engaging a respective cam 40. Carriage 42 is hinged to wheel 16 by a pin 44 to oscillate, with respect to wheel 16, about an axis 45 parallel to axis 18, and is connected mechanically to one end of arm 25 by means of a crank mechanism 46.

Each crank mechanism 46 comprises an arm 47 which, together with arm 25, defines a rocker arm pivoting on and oscillating with respect to wheel 16 about axis 27. Crank mechanism 46 also comprises an arm 48 connected at one end to arm 47 by a hinge 49, and at the other end to carriage 42 by a hinge 50.

As wheel 16 rotates about axis 18, the profiles of cams 40 cause each carriage 42 to oscillate about respective axis 45; the movement produced by the oscillation of carriage 42 is transmitted by arm 48 to arm 47 to oscillate arm 47 and arm 25 about axis 27; and, given the small distance between axes 27 and 18, as shown clearly in FIG. 3, the oscillation of arm 25 about axis 27 causes plate 21 and hence pickup head 19 to move substantially tangentially with respect to the periphery of wheel 16.

Figure 4:
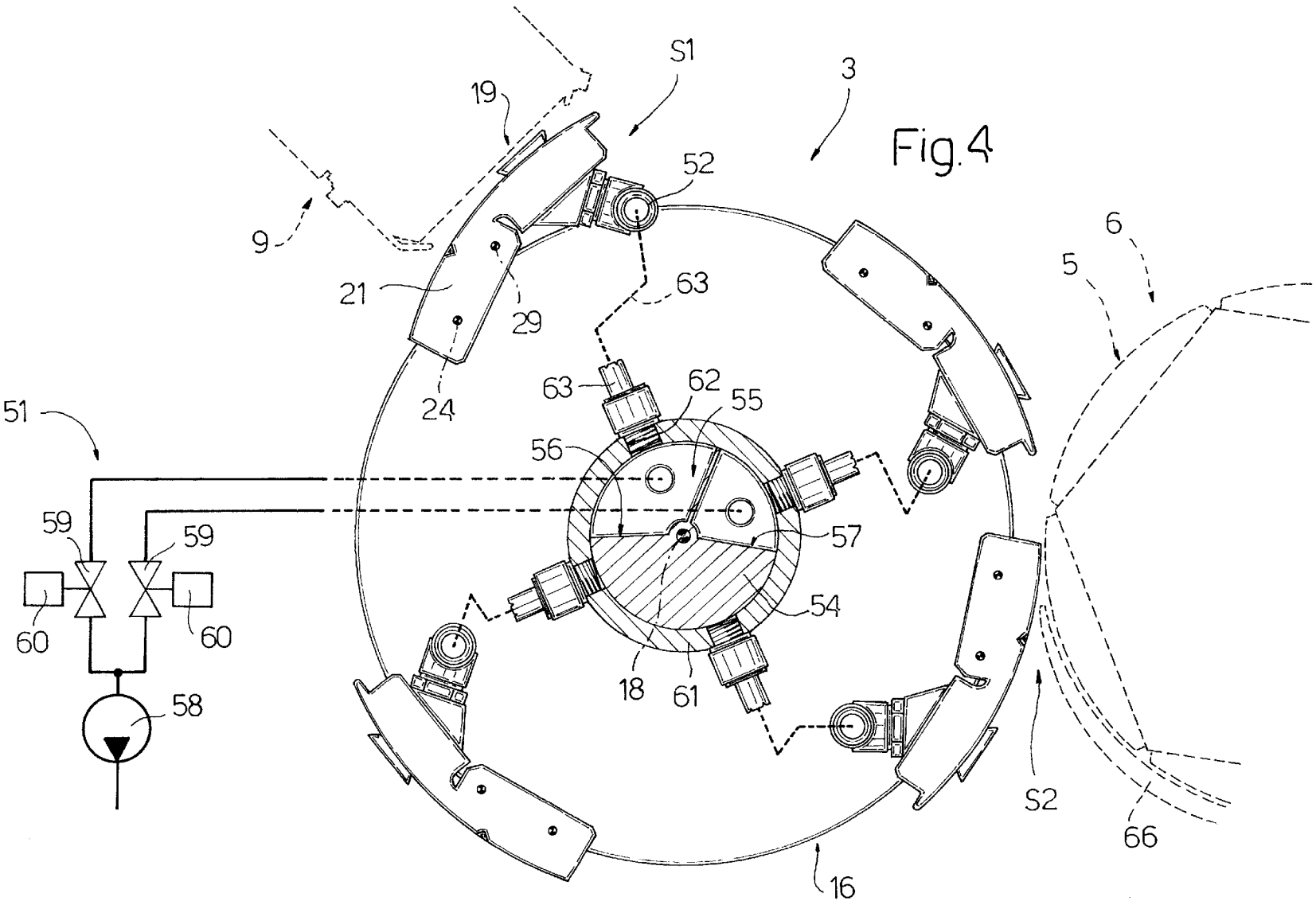

As shown in FIG. 4, unit 3 comprises a suction device 51 connected pneumatically to one end 52 of an inner conduit 53 (FIG. 1) of each pickup head 19 to generate suction through head 19 to retain a respective blank 4 on head 19 as head 19 travels from loading station S1 to unloading station S2.

Suction device 51 comprises a fixed central distributor 54 housed coaxially in wheel 16 and having a chamber 55, which is formed in the outer periphery of distributor 54 and divided into two contiguous, pneumatically isolated sections 56 and 57 located respectively at stations S1 and S2. Each section 56, 57 is connected to a suction pump 58 by a respective valve 59 controlled by a control device 60.

Suction device 51 also comprises a tubular body 61, which is coaxial and rotates with wheel 16, cooperates with distributor 54, and has, for each pickup head 19, a through hole 62 connected pneumatically at one end to distributor 54 and at the other end to respective end 52 by a conduit 63.

As wheel 16 rotates about axis 18, each hole 62 communicates with section 56 as respective pickup head 19 travels through loading station S1, and then communicates, substantially seamlessly, with section 57 as pickup head 19 travels through unloading station S2. The angular extension of sections 56, 57 is such as to activate suction through each pickup head 19 as pickup head 19 starts to engage bottom opening 13 of store 9, and to cut off suction as pickup head 19 faces a seat 5 on conveyor roller 6.

Operation of unit 3 will now be described with reference to one pickup head 19 and as of the instant in which pickup head 19 leaves unloading station S2.

As wheel 16 rotates continuously, pickup head 19 is fed through loading station S1 where actuating device 20 moves pickup head tangentially, i.e. substantially along path P, with respect to wheel 16 to keep head 19 facing bottom opening 13 of store 9 for a long enough time interval to complete withdrawal of a blank 4 at opening 13. During the same time interval, actuating device 20 also moves head 19 radially with respect to wheel 16 by means of said oscillation about respective axis 24 to bring head 19 into contact with blank 4, which adheres to head 19 by virtue of the suction produced, as described, by suction device 51.

As shown in FIG. 5, once blank 4 adheres to head 19, actuating device 20 withdraws head 19 from bottom opening 13 by means of said oscillation about respective axis 24; which oscillation deforms and enables an edge 64 of blank 4 to slip over the front tooth 14 in the traveling direction of head 19 along path P. At the end of the radial movement of head 19, actuating device 20 arrests the tangential movement of head 19, which is once more fed along path P by the continuous rotation of wheel 16 about axis 18; and, as head 19 travels along path P, and edge 65 of blank 4 is withdrawn from beneath the rear tooth 14 in the traveling direction to complete withdrawal of blank 4 from bottom opening 13.

As wheel 16 rotates continuously, head 19 is then fed through unloading station S2 where actuating device 20 sets pickup head 19 to a fixed position substantially tangential with respect to wheel 16 to feed the withdrawn blank 4 to a seat 5 traveling through unloading station S2 together with and substantially tangent to pickup head 19.

Blank 4 is transferred from pickup head 19 to seat 5 by simply cutting off suction, as described, through pickup head 19 and simultaneously activating suction through seat 5. To ensure blank 4 adheres completely to seat 5, provision is made downstream from unloading station S2 for a fixed circular section 66 substantially tangent to seat 5.

The above steps are repeated cyclically.

During normal operation of packing machine 2, a known control unit (not shown) of machine 2 may signal to control device 60 not to supply a blank 4 to conveyor roller 6 on account, for example, of the corresponding product (not shown) having been rejected.

In this case, control device 60 first acts on valve 59 of section 56 to temporarily cut off suction at section 56 and so prevent the pickup head 19 at loading station S1 from withdrawing a blank 4, and to maintain suction at section 57 to enable the previous pickup head 19 traveling towards unloading station S2 to retain the blank 4.

Control device 60 then acts on valve 59 of section 57 to temporarily cut off suction at section 57 and so prevent suction from being activated through an empty pickup head 19, and to maintain suction at section 56 to 15 enable the next pickup head 19 to withdraw a blank 4.

What is claimed is:

1. A unit for supplying blanks on a packing machine, the unit (3) comprising:

a store (9) for storing blanks (4), said store having a bottom opening (13);

a plate (21) having a first end and a second end (22, 23) opposite each other;

a pickup head (19) located close to said first end (22) of said plate (21)for withdrawing a respective blank (4);

a wheel (16) rotating continuously about a first axis (18) to feed said pickup head (19) along an endless path (P) extending through a loading station (S1) where the pickup head (19) engages said bottom opening (13) to withdraw said blank (4), said plate (21) being arranged on the periphery of said wheel (16) and being connected to said wheel (16) to oscillate, with respect to the wheel (16), about a second axis (24) extending through said second end (23) and parallel to said first axis (18);

an actuating device (20) comprising a first transmission (30, 38) for varying the angular position of said plate (21) about said second axis (24), and a second transmission (25, 46) for oscillating said plate (21), with respect to said wheel (16), about a third axis (27) parallel and relatively close to said first axis (18) and along said path (P);

said first end and said second end (22, 23) being aligned along said path (P);

said first end (22) being a front end in a traveling direction of said pickup head (19) along said path (P);

said first transmission (30, 38) being connected to said plate (21) at an intermediate point between said first end and said second end (22, 23) about a fourth axis (29) parallel to said first axis (18); and said second transmission (25; 46) being connected to said plate (21) about said second axis (24).

2. A unit as claimed in claim 1 comprising first cam control means (31) connected to said first transmission (30, 38) to control the angular position of said plate (21) about said second axis (24).

3. A unit as claimed in claim 1, wherein said first cam control means (31) comprise a fixed first cam (32) extending about said first axis (18); and a first follower device (33) cooperating with said first cam (32) and having a first carriage (34) hinged to said wheel (16) to oscillate, with respect to said wheel (16), about a fifth axis (37) parallel to said first axis (18); said first transmission (30, 38) comprising a first arm (30), which is hinged at one end to said plate (21) at said intermediate point, and is hinged at the opposite end to said first carriage (34) via a second arm (38) angularly integral with the first carriage (34).

4. Unit as claimed in claim 3 comprising a conveyor roller (6) rotating continuously about a sixth axis (7) and substantially tangent to said wheel (16) at an unloading station (S2) where the blank (4) is unloading off said wheel (16).

5. A unit for supplying blanks on a packing machine, the unit (3) comprising:

a store (9) for storing blanks (4), said store (9) having a bottom opening (13);

a plate (21) having a first end and a second end (22, 23) opposite each other;

a pickup head (19) located close to said first end (22) of said plate (21) for withdrawing a respective blank (4);

a wheel (16) rotating continuously about a first axis (18) to feed said pickup head (19) along an endless path (P) extending through a loading station (S1) where the pickup head (19) engages said bottom opening (13) to withdraw said blank (4), said plate (21) being connected to said wheel (16) to oscillate, with respect to the wheel (16), about a second axis (24) extending through said second end (23) and parallel to said first axis (18);

an actuating device (20) comprising a first transmission (30, 38) for varying the angular position of said plate (21) about said second axis (24), and a second transmission (25, 46) for oscillating said plate (21), with respect to said wheel (16), about a third axis (27) parallel and relatively close to said first axis (18) and along said path (P);

and second cam control means (28) connected to said second transmission (25, 46) to control the angular position of said plate (21) about said third axis (27), said second cam control means (28) comprising two fixed cams (40) extending about said first axis (18);

and a second follower device (41) cooperating with said two fixed cams (40) and having a second carriage (42) hinged to said wheel (16) to oscillate about a fifth axis (45) parallel to said first axis (18); and said second transmission (25, 46) comprising a third arm (25), which is hinged at one end to said plate (21) to oscillate, with respect to said plate (21), about said second axis (24), and is hinged at the opposite end to said wheel (16) to oscillate, with respect to said wheel (16), about said third axis (27).

6. A unit as claimed in claim 5, wherein said second transmission (25, 46) comprises a fourth arm (47) angularly integral with said third arm (25); and a fifth arm (48) hinged at one end to said second carriage (42) and at the opposite end to said fourth arm (47).

7. A unit for supplying blanks on a packing machine, the unit (3) comprising:

a store (9) for storing blanks (4), said store (9) having a bottom opening (13);

a plate (21) having a first end and a second end (22, 23) opposite each other;

a pickup head (19) located close to said first end (22) of said plate (21) for withdrawing a respective blank (4);

a wheel (16) rotating continuously about a first axis (18) to feed said pickup head (19) along an endless path (P) extending through a loading station (S1) where the pickup head (19) engages said bottom opening (13) to withdraw a said blank (4), said plate (21) being connected to said wheel (16) to oscillate, with respect to the wheel (16), about a second axis (24) extending through said second end (23) and parallel to said first axis (18);

an actuating device (20) comprising a first transmission (30, 38) for varying the angular position of said plate (21) about said second axis (24), and a second transmission (25, 46) for oscillating said plate (21), with respect to said wheel (16), about a third axis (27) parallel and relatively close to said first axis (18) and along said path (P);

and a suction device (51) connected pneumatically to said pickup head (19) to generate suction through the pickup head (19) as the pickup head (19) travels from said loading station (S1) to said unloading station (S2) said suction device (51) comprises a suction pump (58);

a central fixed distributor (54) housed coaxially in said wheel (16) and having a chamber (55) formed in the outer periphery of the fixed distributor (54) and divided into two contiguous, pneumatically isolated sections (56, 57);

a tubular body (61) integral and coaxial with said wheel (16), cooperating with said fixed distributor (54); and two valves (59) for respectively connecting said pump (58) to said two sections (56, 57);

a first (56) of said two sections being located at said loading station (S1), and a second (57) of said two sections being located at said unloading station (S2).

* * * * *